United States Patent [19]

Watanabe

[11] Patent Number: 4,879,994

[45] Date of Patent: Nov. 14, 1989

[54] DEVICE FOR MEDICALLY TREATING HIP JOINT INSUFFICIENCY, ETC.

[76] Inventor: Hazime Watanabe, 11168-4, Sugita, Fujinomiya, Shizuoka, Japan

[21] Appl. No.: 146,681

[22] Filed: Jan. 21, 1988

[30] Foreign Application Priority Data

Apr. 16, 1987 [JP] Japan ..... 62-57860

[51] Int. Cl.[4] ..... A61F 5/00

[52] U.S. Cl. ..... 128/70; 128/68

[58] Field of Search ..... 128/68, 69, 70, 73, 128/74, 25 R; 269/322-328; 272/101, 102

[56] References Cited

U.S. PATENT DOCUMENTS 3,012,776 12/1961 Hotas ..... 128/25 R 3,612,042 10/1971 Fry ..... 128/25 R

*Primary Examiner*—Edgar S. Burr

*Assistant Examiner*—Aaron J. Lewis

*Attorney, Agent, or Firm*—Wenderoth, Lind & Ponack

[57] ABSTRACT

A device for medically treating a hip joint insufficiency, or the like comprises a supporting post, a swinging arm swingably mounted on a shaft pivotally mounted to the supporting post, and a leg hanger hanging from the shaft and held by a bifurcated member on a free end of the swinging arm and able to swing together with the swinging arm. The device also includes a hip presser mounted on an upper end of the supporting post and a leg support is mounted on a lower end of the supporting post.

9 Claims, 3 Drawing Sheets

DEVICE FOR MEDICALLY TREATING HIP JOINT INSUFFICIENCY, ETC.

BACKGROUND OF THE INVENTION

1. Field of the Invention

The present invention relates to a device for medically treating hip joint insufficiency, or the like, which is suitably used for treating a contracture or relaxation of joint muscle such as that of the hip joint, lumbar, and shoulder joints, and adhesion of the sacrum.

2. Background of the Invention

Relaxation and contracture of a joint muscle of a shoulder joint or a hip joint, adhesion of the sacrum, etc. are examples of a disease which greatly limits the movable area of the joint and which disturbs a smooth swinging motion of the hand, leg, waist, etc. thereby to make it difficult to walk or to perform a normal manual task.

In the wernicke mann contracture as a representative example thereof, the joints of the right or left hand or leg are caused to be dislocated. As a result, the so-called circumduction gait is obliged. If the shoulder joint muscle is contracted, the upper arm bone and the shoulder blade must be moved simultaneously.

Heretofore, as a method for enhancing a recovery, there has been performed, for a long time, rehabilitation such as a pendulum motion exercise using something heavy, walking/manual work exercise, or various kinds of stimulation treatment. Since this is the actual situation, there is a need for providing an effective medical treatment device in which the contracture or relaxation of muscle can be fundamentally cured.

SUMMARY OF THE INVENTION

The present invention has been developed in order to solve the afore-mentioned problems inherent in the prior art. It is therefore the general object of the present invention to provide a medical treatment device which is very effective for treating contracture, relaxation, etc. of the hip joint muscle, or the like.

In order to achieve the above-mentioned object, a device for medically treating a hip joint insufficiency or the like according to the present invention comprises a supporting post, a swinging arm swingably mounted to said supporting post at a desirable angle, and a leg hanger hanging from said swinging arm and able to swing together with said swinging arm. When the disease is a hip joint insufficiency, a sacrum adhesion or the like, the patient lies on a bed or the like and puts his leg in the leg hanger, and similarly, when the disease is a shoulder joint insufficiency or the like, he puts his arm in the leg hanger to remove the effects of gravity and free the leg or arm so as to be under the control of the leg hanger, and in the foregoing posture, the leg or arm is applied with an objective free swinging motion while leaving it to the swinging motion of the swingable arm. In this way, the disease can be effectively recovered.

According to the present invention, the leg or the arm having no freedom of movement on its own is rested on the leg hanger so as to be free of gravity and allow freedom thereof under the control of the leg hanger, and the leg or the arm is swung about the swingable arm as if the swingable arm were the joint thereof. By this arrangement, the contracting or relaxing portion of the hip joint muscle or the like can be directly subjected to a recovering treatment. The present invention has proven to be extremely effective through many clinical experiments in which the diseased portion is recovered in a very short time.

Further, as a medical treatment device, the device according to the present invention is very simple in structure and rapid in effect.

The above and other objects and features of the present invention will become apparent to those skilled in the art upon reading the following detailed description with reference to the accompanying drawings in which:

DETAILED DESCRIPTION OF THE PREFERRED EMBODIMENT

One preferred embodiment of the present invention will be described hereunder with reference to the accompanying drawings.

Figure 1:
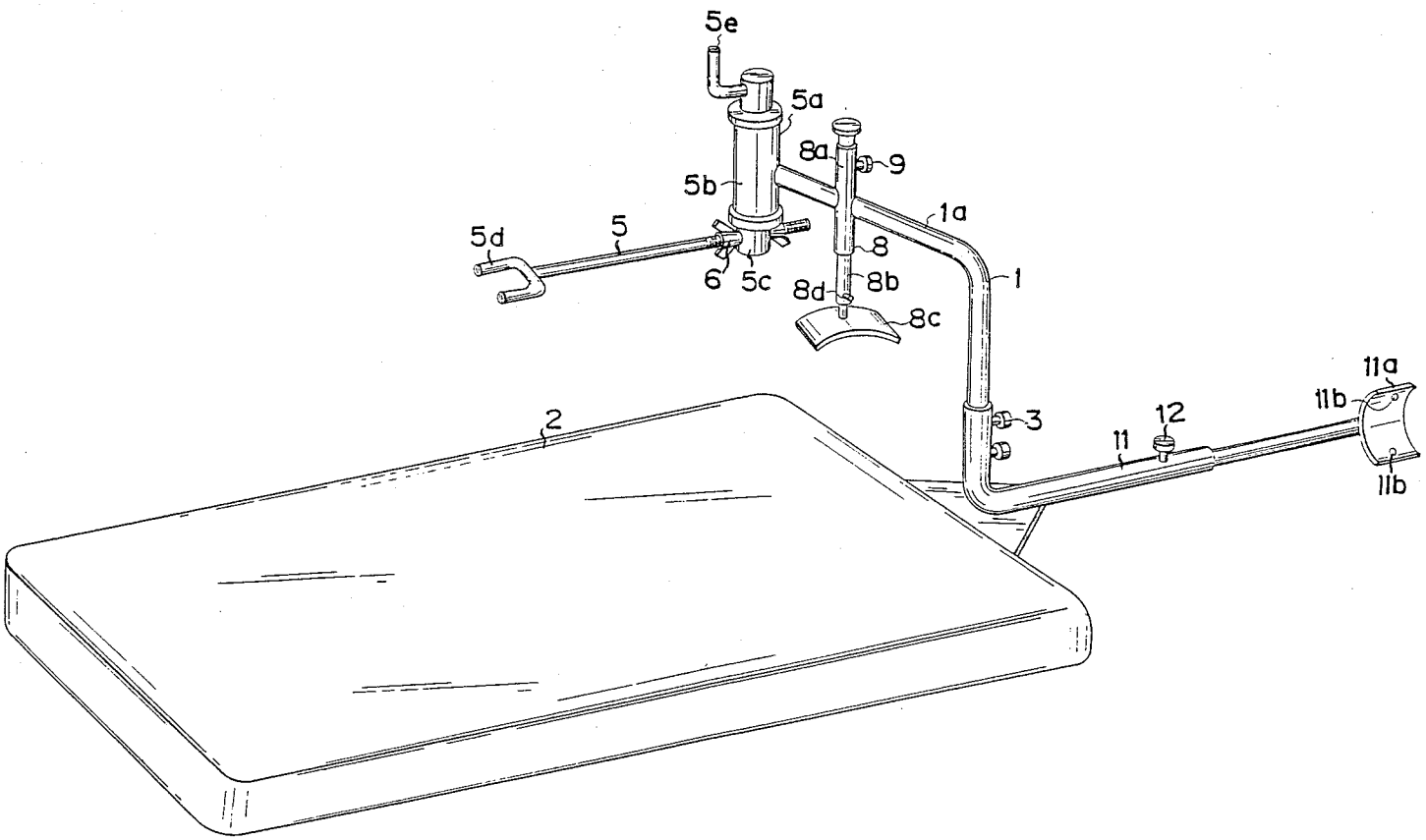
FIG. 1 is a perspective view of a device for medically treating a hip joint insufficiency or the like according to one embodiment of the present invention.
Figure 2:
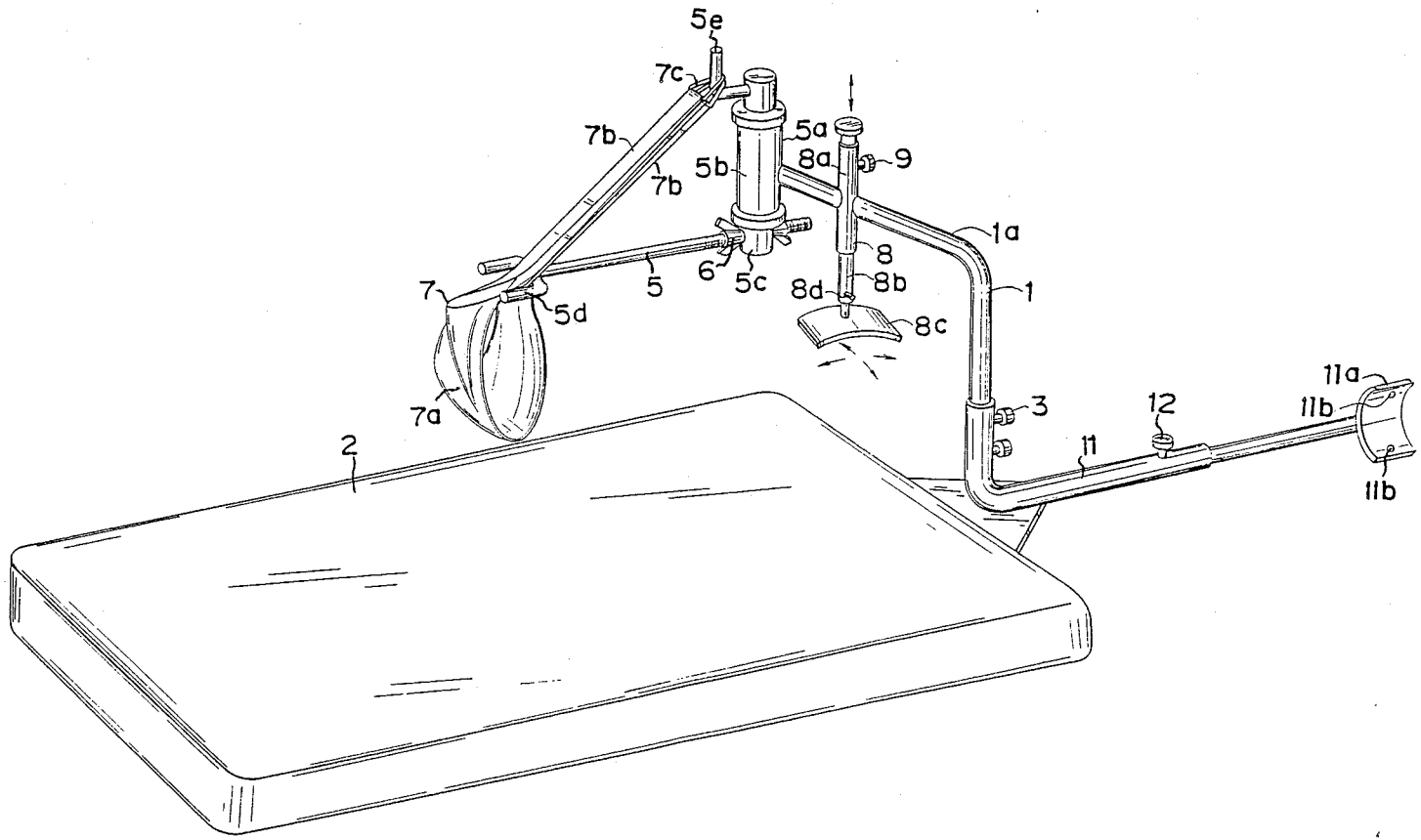
FIG. 2 is a perspective view of the medical treatment device of FIG. 1 but equipped with a leg hanger.

In FIGS. 1 and 2, reference numeral 1 denotes a supporting post for supporting a swinging arm 5. The supporting post 1 is adjustable in height and in angle. For example, as is shown in the figures, a plurality of pipes are formed in a multi-stage telescopic structure so that they can be freely rotated (angle adjustment) and expanded or contracted (height adjustment). The pipes are secured to each adjusted position by screws 3.

The supporting post 1 is formed at an upper end thereof with a generally hook shaped hanging arm 1*a* at a predetermined angle of elevation. The foremost end portion thereof is provided with the swinging arm 5 pivotably attached thereto through a hinge 5*a*. As the hinge 5*a* of the swinging arm 5, a cylindrical member 5*b* is vertically attached thereto and the cylindrical member 5*b* is rotatably penetrated by a shaft 5*c*, and the swinging arm 5 is horizontally pivotably attached to a lower end thereof. The swinging arm 5 is attached to the shaft 5*c* through a butterfly nut 6 or the like in such a manner that the projecting length thereof is adjustable, and the foremost end thereof is provided with a bifurcated member 5*d* as a catching member of a leg hanger 7 as will be described. The shaft 5*c* is provided at an upper end thereof with a retaining device 5*e* of the leg hanger 7.

Figure 3:
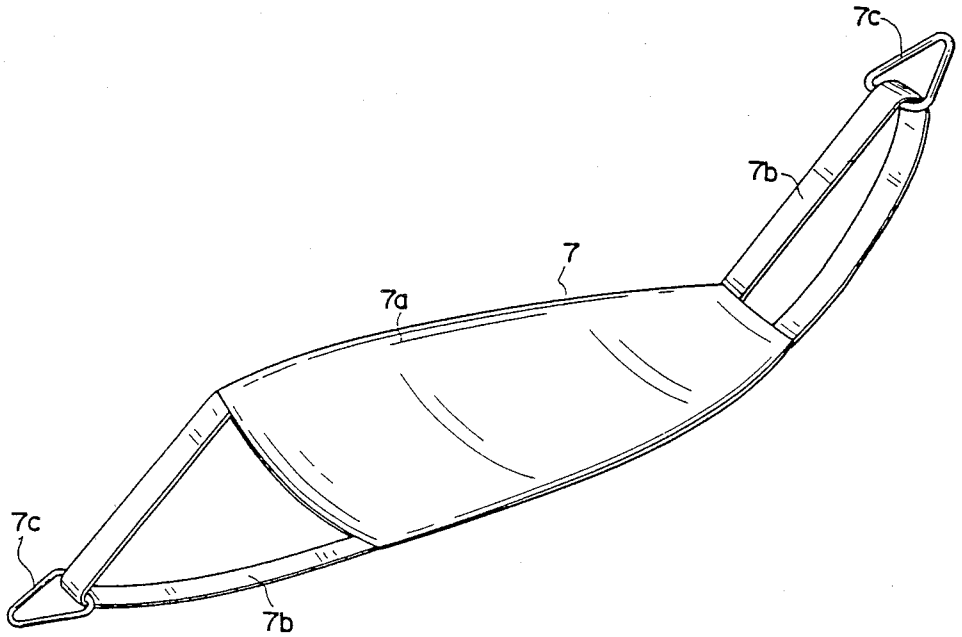
FIG. 3 is a perspective view of the leg hanger of FIG. 2.

The leg hanger 7 also serves as an arm hanger. As shown in FIGS. 2 and 3, a hanging belt 7*a* formed of sheet material (including net material) is provided at both ends thereof with a hanger strap 7*b*, respectively. Each hanger strap 7*b* is provided at an end portion thereof with a hanging device 7*c*.

As described in the foregoing, the swinging arm 5 has the bifurcated member 5*d* at the foremost end thereof and the shaft 5*c* has the retaining device 5*e*. The leg hanger 7 is hung on the retaining device 5*e* by the hanging devices 7*c* of the hanger straps 7*b*, the base portion including the environment of the hanger 7*b* is bundled and caught by the bifurcated member 5*d*, and the hanging belt 7*a* is hung down therefrom.

As such, the hanging belt 7*a* is hung down from the swinging arm 5 by the bifurcated member 5*d* and retaining device 5*e* and freely swung together with the shaft 5*c*.

As an additional structure, the hanging arm 1*a* of the supporting post 1 is provided with a hip presser 8 which also serves as a shoulder presser. In order to secure the hip presser 8, a cylindrical member 8*a* is vertically attached to the hanging arm 1*a*, a shaft 8*b* is vertically movably pierced through the cylindrical member 8*a* so that the height thereof can be adjusted and then secured to an adjusted position. A pad 8*c* is floatably attached to a lower end of the shaft 8*b* by a connecting pin 8*d*. The presser pad 8*c* is formed of, for example, an arcuate presser plate.

As a still additional structure, the supporting post 1 is provided at a lower end thereof with a leg supporting arm 11 of a generally L-shape, a horizontally extending part of the leg supporting arm 11 is provided at a foremost end thereof with a leg supporting pad 11*a*, the leg supporting pad 11*a* is provided with leg securing means such as, for example, a string hole 11*b*, and a string or the like is inserted into the hole 11*b* to bind the leg, calf, ankle, etc. to the pad 11*a*. The leg supporting arm 11, like the supporting post 1, is formed in a telescopic structure so that the length thereof can be adequately adjusted, and is secured to the adjusted position by a fastening screw 12.

The apparatus having the above-mentioned structure is installed at a central portion of one end of a bed 2 as shown in FIG. 1, and the swinging arm 5 is swingably disposed above the bed 2. In addition, the leg supporting arm 11 is disposed in a direction away from the bed 2.

The invention will be further described in detail taking a hip joint treatment as an example. The patient lies on the bed 2 with his legs holding the supporting post 1 therebetween, and permits his one leg to stretch along the leg supporting arm 11 to be secured to the leg supporting pad 11*a*. On the other hand, the other leg suffering from a muscle insufficiency is bent generally in a dogleg shape at the knee joint portion and rested in the leg hanger 7 and retained by the hanger 7 is hung device 5*e*. The hanger strap 7*b* is caught by the bifurcated member 5*c* at the foremost end of the swinging arm 5.

In this way, one leg of the patient to be treated is placed in the leg hanger 7 and supported in the air. Then, the butterfly nut 6 is loosened according to the need to adequately adjust the projecting length of the swinging arm 5 and also to adjust the height of the leg hanger 7, therefore, to adjust the hanging height as well as the forward and back position of the leg. The height adjustment can also be made by loosening the fastening screw 3 of the supporting post 1 and expanding or contracting the supporting post 1.

Then, the supporting post 1 is swung to bring the hip presser pad 8 into the center of the hip portion and allow the hip presser pad 8 to slightly press the hip portion while adjusting the height thereof by the fastening screw 9.

When the shoulder joint is to be treated, the arm is supported by the leg hanger 7 and the center of the shoulder of the diseased portion is pressed by the presser pad 8.

In this way, the patient's leg or arm is supported in the air by the leg hanger 7 leaving the effects of gravity and freedom thereof under the control of the leg hanger 7. While permitting the movement thereof to coincide with the swinging movement of the swinging arm 5 in the foregoing posture, the leg or arm is applied with an objective free swinging movement to cure or recover the relaxed or contracted hip joint muscle or shoulder joint muscle. The above-mentioned procedure for treating the hip joint muscle is likewise applicable to treat adhesion of the sacrum and the lumbar.

According to the present invention, in order to treat the leg or arm which is unable to move freely, the leg or arm is put into the leg hanger and, while leaving the effects of gravity and freedom thereof under the control of the leg hanger, the leg or the arm is freely swung about the swinging arm 5 as if the swinging arm 5 were the joint thereof. By this, the contracting or relaxing portion of the hip joint muscle or the like is concentratedly and directly given a recovering treatment, thereby to effectively recover the leg or arm. Many clinical experiments using the above-mentioned medical treatment device prove that the diseased portions have been favorably recovered in a very short time. Therefore, a long treatment time is not compelled as in the case of the conventional rehabilitation exercise. Even in the case of a heavy or serious disease, the use of the medical treatment device of the present invention together with the rehabilitation exercise is very effective to obtain an early recovery of the diseased leg or arm.

Thus, the medical treatment device of the present invention is very simple in structure and inexpensive to manufacture. In addition, a rapid effect can be obtained.

The device for medically treating a hip joint insufficiency or the like according to the present invention has heretofore been explained in detail with reference to the illustrative and preferred embodiment. However, it is not intended to restrict the scope of the present invention to the specific embodiment as set forth above, on the contrary, it should be appreciated that the present invention includes various kinds of variations, alternatives, modifications and equivalents as may be included within the scope and spirit of the present invention as defined by the appended claims.

What is claimed is:

1. A device for medically treating a condition such as a hip joint problem, comprising:

a supporting post extending in a vertical direction;

a shaft extending in a vertical direction and rotatably supported at a free end of said supporting post, said shaft including a retaining device at an upper end thereof;

a swinging arm extending in a horizontal direction and supported at a lower end of said shaft, said swinging arm having a free end spaced from said shaft, said free end of said swinging arm being movable towards and away from said shaft for positioning thereof and said free end of said swinging arm comprising a bifurcated member;

a hanger for holding a body part such as a leg, said hanger comprising a hanging belt having hanger straps extending from opposite ends thereof and hanging devices at free ends of said hanger straps, said hanging devices being attached to said retaining device and said hanger straps being supported by said bifurcated member at respective portions of said hanger straps adjacent to said hanging belt; and a presser for pressing against a body part such as a hip, said presser including a member supported on said supporting post, said member extending in a vertical direction and having a free end thereof spaced from said supporting post, said free end of said member being movable toward and away from said supporting post for positioning thereof, said presser further including a pad mounted on said free end of said member.

2. The medical device of claim 1, further comprising a bed, said supporting post having a lower end thereof supported on said bed, said supporting post being curved such that an upper end thereof extends over said bed.

3. The medical device of claim 1, further comprising a supporting arm for supporting a body part such as a leg, said supporting arm extending in a horizontal direction from a lower end of said supporting post, said supporting arm having a free end thereof spaced from said supporting post and being movable toward and away from said supporting post for positioning thereof, said supporting arm further including a pad mounted on said free end of said supporting arm.

4. A device for medically treating a condition such as a hip joint problem, comprising:

a supporting post extending in a vertical direction;

a swinging arm extending in a horizontal direction and pivotally supported on said supporting post, said swinging arm having a free end spaced from said supporting post, said free end of said swinging arm being movable towards and away from said supporting post for positioning thereof; and a hanger for holding a body part such as a leg, said hanger comprising a hanging belt supported by said supporting post and said free end of said swinging arm such that a portion of said hanging belt extends below said swinging arm for holding the body part; and a presser for pressing against a body part such as a hip, said presser including a member supported on said supporting post, said member extending in a vertical direction and having a free end thereof spaced from said supporting post, said free end of said member being movable toward and away from said supporting post for positioning thereof, said presser further including a pad mounted on said free end of said member.

5. The medical device of claim 4, further comprising a bed, said supporting post having a lower end thereof supported on said bed, said supporting post being curved such that an upper end thereof extends over said bed.

6. The medical device of claim 4, further comprising a supporting arm for supporting a body part such as a leg, said supporting arm extending in a horizontal direction from a lower end of said supporting post, said supporting arm having a free end thereof spaced from said supporting post and being movable toward and away from said supporting post for positioning thereof, said supporting arm further including a pad mounted on said free end of said supporting arm.

7. A device for medically treating a condition such as a hip joint problem, comprising:

a supporting post extending in a vertical direction;

a swinging arm extending in a horizontal direction and pivotally supported on said supporting post, said swinging arm having a free end spaced from said supporting post, said free end of said swinging arm being movable towards and away from said supporting post for positioning thereof and said free end of said swinging arm comprising a bifurcated member;

a hanger for holding a body part such as a leg, said hanger comprising a hanging belt supported by said swinging arm such that a portion of said hanging belt extends below said swinging arm for holding the body part;

a presser for pressing against a body part such as a hip, said presser including a member supported on said supporting post, said member extending in a vertical direction and having a free end thereof spaced from said supporting post, said free end of said member being movable toward and away from said supporting post for positioning thereof, said presser further including a pad mounted on said free end of said member; and a bed, said supporting post having a lower end thereof supported on said bed.

8. The medical device of claim 7, further comprising a supporting arm for supporting a body part such as a leg, said supporting arm extending in a horizontal direction from a lower end of said supporting post, said supporting arm having a free end thereof spaced from said supporting post and being movable toward and away from said supporting post for positioning thereof, said supporting arm further including a pad mounted on said free end of said supporting arm.

9. The medical device of claim 8, wherein said supporting post is curved such that an upper end thereof extends over said bed, said swinging arm being pivotally attached to said upper end of said supporting post.

* * * * *

UNITED STATES PATENT AND TRADEMARK OFFICE

CERTIFICATE OF CORRECTION

PATENT NO. : 4,879,994

DATED : November 14, 1989

INVENTOR(S) : Hazime WATANABE

It is certified that error appears in the above-identified patent and that said Letters Patent is hereby corrected as shown below:

Title page item [76] in the address of the applicant, for "11168-4", read --1168-4--.

Signed and Sealed this

Twenty-fourth Day of September, 1991

*Attest:*

HARRY F. MANBECK, JR.

*Attesting Officer*

*Commissioner of Patents and Trademarks*